US005083794A

United States Patent [19]

Santagata

[11] Patent Number: 5,083,794

[45] Date of Patent: Jan. 28, 1992

[54] TRIVIA GAME

[76] Inventor: Raymond A. Santagata, 6 Mills Dr., Johnston, R.I. 02919

[21] Appl. No.: 594,610

[22] Filed: Oct. 9, 1990

[51] Int. Cl.[5] ..... A63F 3/00

[52] U.S. Cl. ..... 273/249

[58] Field of Search ..... 273/240, 243, 248, 249, 273/242

[56] References Cited

U.S. PATENT DOCUMENTS

| | | | |
|---|---|---|---|
| 2,717,156 | 9/1955 | Nelson | 273/248 |
| 4,029,320 | 6/1977 | Hausman | 273/249 |
| 4,121,823 | 10/1978 | McBride | 273/243 X |
| 4,273,337 | 6/1981 | Carrera et al. | 273/243 |
| 4,326,711 | 4/1982 | Giallombardo | 273/142 H A |
| 4,807,878 | 2/1989 | Tripp | 273/237 X |
| 4,900,033 | 2/1990 | Campos et al. | 273/249 |

FOREIGN PATENT DOCUMENTS

| | | | |
|---|---|---|---|
| 1377832 | 12/1974 | United Kingdom | 273/243 |
| 2206285 | 1/1989 | United Kingdom | 273/242 |

*Primary Examiner*—Edward M. Coven
*Assistant Examiner*—William E. Stoll
*Attorney, Agent, or Firm*—Leon Gilden

[57] ABSTRACT

A trivia game is set forth, and a method of play therefore, wherein the game includes a game board defined by a rectangular matrix of columns, each column containing a predetermined number of spaces. The spaces originate at a first date and descend in equally spaced chronological order to a final date of a predetermined time interval in history. Play is directed along a single continuous serpentine path between adjacent columns, with movement directed by a spinner member, with the spinner member including an annulus of various colorations. Each coloration is in association with a deck of cards of a like coloration, whereupon correct response relative to a predetermined date in the serpentine path of travel directs a player of a plurality of players to proceed. A further category of spaces randomly positioned throughout the serpentine path directs an individual to proceed in a loss of a predetermined number of spaces along the path and lose a turn.

1 Claim, 3 Drawing Sheets

13
14
15
16
18
SPORTS
18
MUSIC
18
MOVIES
18
FAMOUS PEOPLE

TRIVIA GAME

BACKGROUND OF THE INVENTION

1. Field of the Invention

The field of invention relates to games and methods of play, and more particularly pertains to a new and improved trivia game wherein the same directs association with the decade of the 1950's and provides educational entertainment in association with an understanding of various categories of knowledge of that decade.

2. Description of the Prior Art

Various trivia type games for educational and amusement purposes have been provided in the prior art. Examples of such may be found in U.S. Pat. No. 4,807,878 to Tripp wherein a trivia game utilizes various categories of cards in association with a spinner and associated scoring in response to correct answers of the questions within the various categories of cards utilized.

U.S. Pat. No. 4,856,780 to Begley sets forth a sports trivia type game wherein a perimeter path of various colored playing spaces is provided, with scoring directed on a score board in response to correct answers of the game.

U.S. Pat. No. 4,884,815 to Glenn sets forth an automotive type game utilizing cards and a time interval to permit players to correctly respond to various trivia questions provided by the cards.

U.S. Pat. No. 4,674,752 to Brothers sets forth a trivia game relative to questions and answers relating to history, geography and the like of various States in the Union.

As such, it may be appreciated that there continues to be a need for a new and improved trivia game as set forth by the instant invention which addresses both the problems of ease of use as well as convenience and entertainment in play and as such, the present invention substantially fulfills this need.

SUMMARY OF THE INVENTION

In view of the foregoing disadvantages inherent in the known types of trivia games now present in the prior art, the present invention provides a trivia game wherein the same employs a single continuous serpentine path along a game board, with the serpentine path associating chronologically descending dates and randomly selected categories of cards utilized to permit a player of a plurality of players to proceed along the path to termination of play. As such, the general purpose of the present invention, which will be described subsequently in greater detail, is to provide a new and improved trivia game which has all the advantages of the prior art trivia games and none of the disadvantages.

To attain this, the present invention provides a trivia game setting forth a method of play, wherein the game includes a game board defined by a rectangular matrix of columns, each column containing a predetermined number of spaces. The spaces originate at a first date and descend in equally spaced chronological order to a final date of a predetermined time interval in history. Play is directed along a single continuous serpentine path between adjacent columns, with movement directed by a spinner member, with the spinner member including an annulus of various colorations. Each coloration is in association with a deck of cards of a like coloration, whereupon correct response relative to a predetermined date in the serpentine path of travel directs a player of a plurality of players to proceed. A further category of spaces randomly positioned throughout the serpentine path directs an individual to proceed in a loss of a predetermined number of spaces along the path and lose a turn.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved trivia game which has all the advantages of the prior art trivia games and none of the disadvantages.

It is another object of the present invention to provide a new and improved trivia game which may be easily and efficiently manufactured and marketed.

It is a further object of the present invention to provide a new and improved trivia game which is of a durable and reliable construction.

An even further object of the present invention is to provide a new and improved trivia game which is susceptible of a low cost of manufacture with regard to both materials and labor, and which accordingly is then susceptible of low prices of sale to the consuming public, thereby making such trivia games economically available to the buying public.

Still yet another object of the present invention is to provide a new and improved trivia game which provides in the apparatuses and methods of the prior art some of the advantages thereof, while simultaneously overcoming some of the disadvantages normally associated therewith.

Still another object of the present invention is to provide a new and improved trivia game wherein the same employs various categories of cards to direct play along a chronologically descending serpentine path defined by a matrix of rows and columns of spaces.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
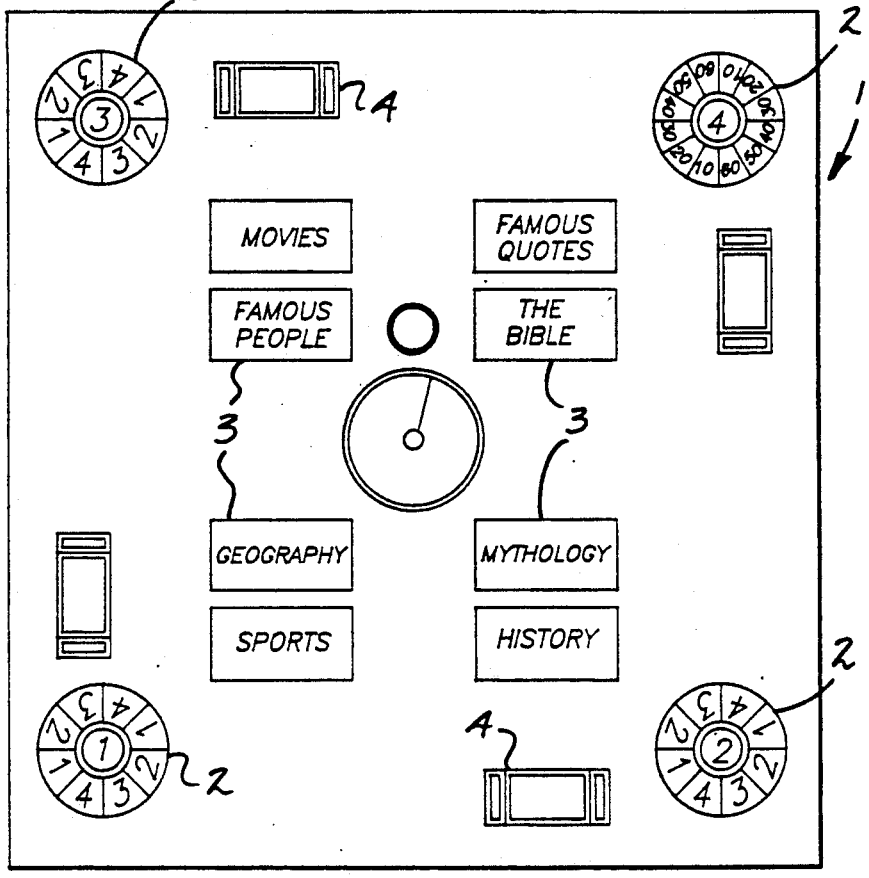
FIG. 1 is an orthographic top view of a prior art trivia type game.
Figure 2:
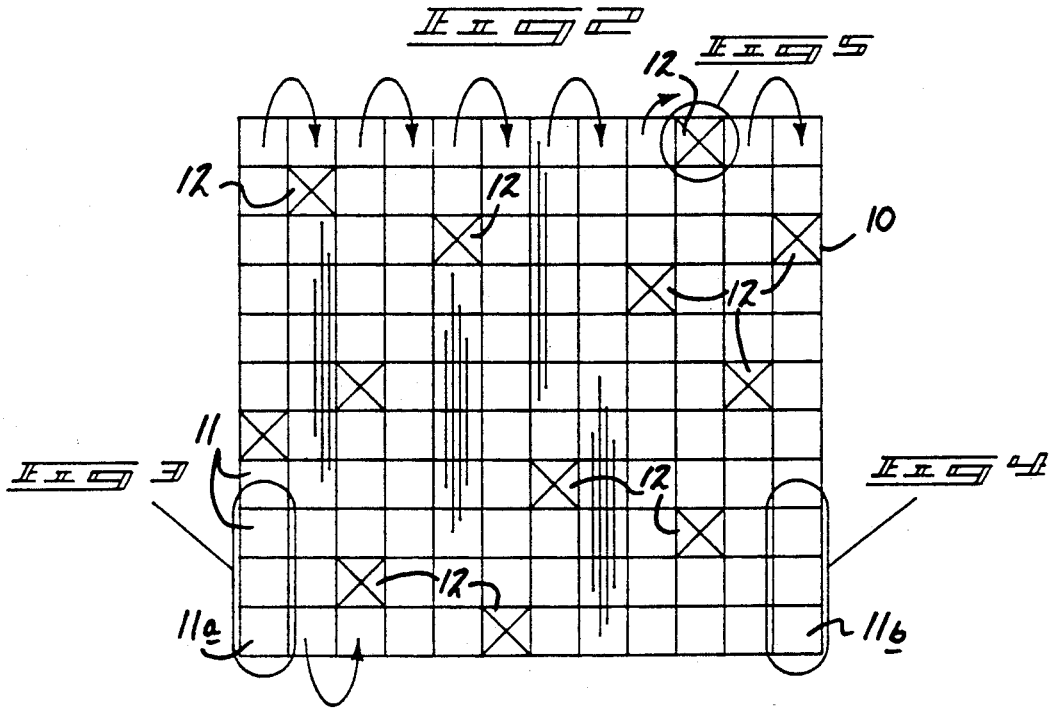
PRIOR ART FIG 2
FIG. 2 is an orthographic top view of the board utilized by the instant invention.
Figure 3:
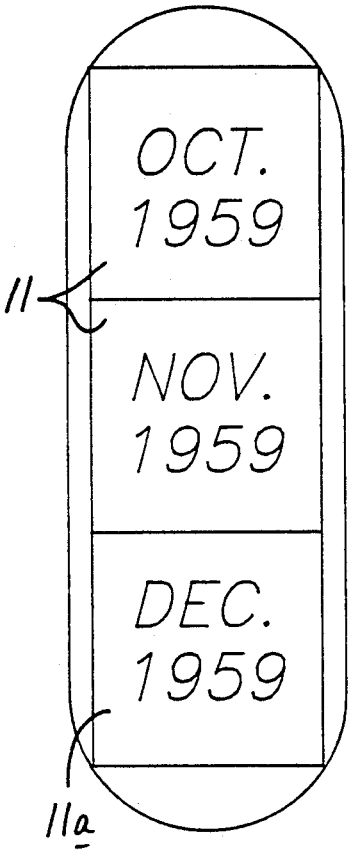
FIG. 3 is an enlarged orthographic view of section 3 as set forth in FIG. 2.
Figure 4:
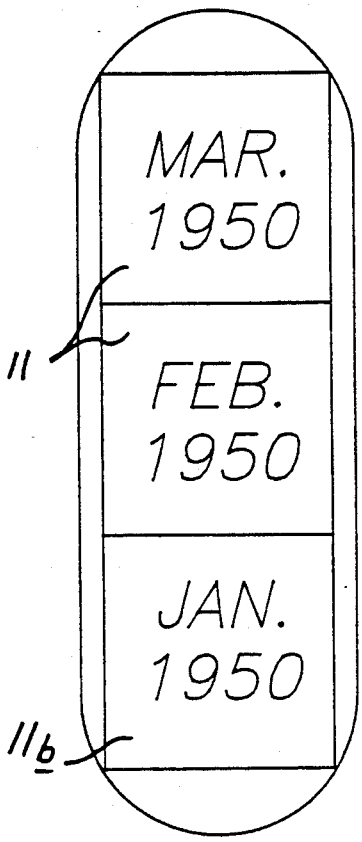
FIG. 4 is an enlarged orthographic view of section 4 as set forth in FIG. 2.
Figure 5:
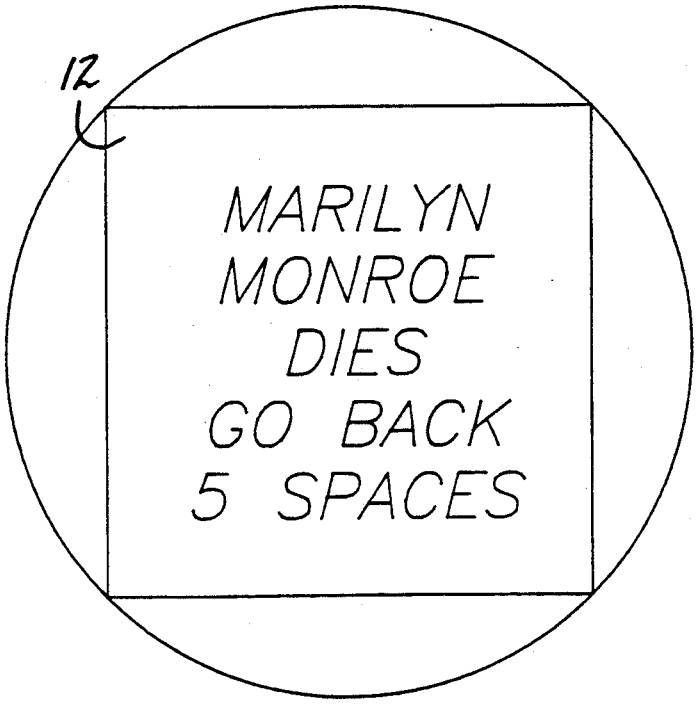
FIG. 5 is an enlarged orthographic view of section 5 as set forth in FIG. 2.
Figure 6:
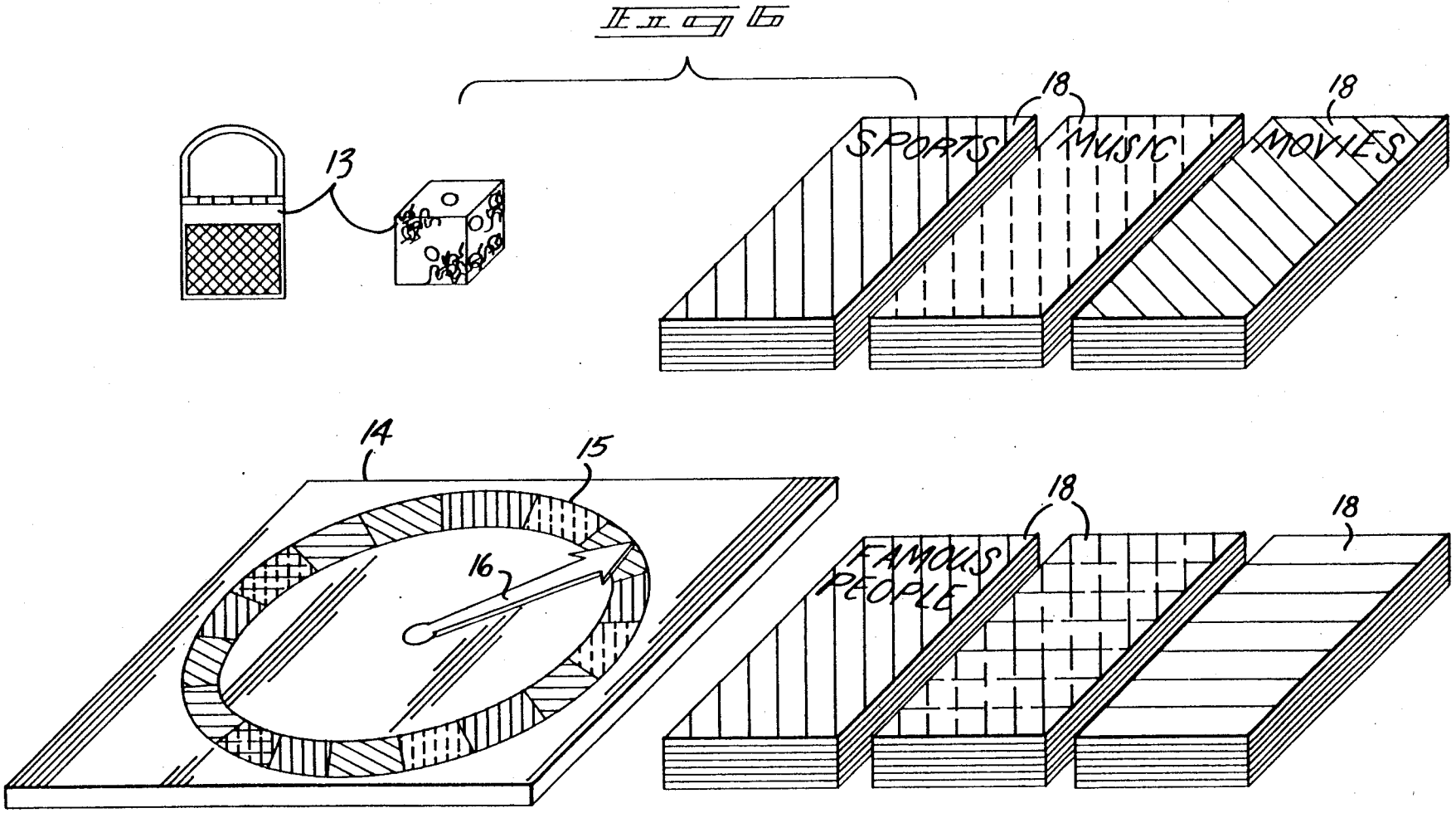
FIG. 6 is an isometric illustration of the components utilized in play in association with the board of the instant invention.

With reference now to the drawings, and in particular to FIGS. 1 to 6 thereof, a new and improved trivia game embodying the principles and concepts of the present invention and generally designated by the reference numerals 10 to 18 will be described.

FIG. 1 illustrates a prior art trivia game 1, in a manner as set forth in U.S. Pat. No. 4,807,878, wherein various spinners 2 direct players to respond to questions within the cards 3, with the correct responses tallied within various scorekeeping members 4.

More specifically, the trivia game and its method of play of the instant invention essentially comprises the providing of a game board 10 defined as a rectangular matrix of spaces defined by parallel rows and orthogonally oriented parallel columns of the spaces. The spaces include first spaces 11 utilizing 132 spaces, each space designating a separate month in the 120 months from December, 1959 to January, 1950 to define the 1950's. Randomly dispersed within the game board and matrix of spaces are second spaces 12 which are penalty spaces, whereupon a player landing thereon is directed to move rearwardly a predetermined number of spaces. Typically, the space is associated with a random event, such as the death of Marilyn Monroe. A serpentine path is defined within the matrix of spaces that is directed along the parallel columns, where an individual proceeds from a starting space 11*a* at the lowermost left-hand column and proceeds to an uppermost space of that column, and then to an adjacent right column and proceeds downwardly of that column to a bottom space of the right column and to an adjacent bottom space of a further right column to define a single continuous serpentine path that alternates a vertical direction in adjacent columns until a player of a plurality of players is declared a winner by landing upon the ending space 11*b* defined by the lowermost space of the rightmost column of the plurality of columns of spaces. Each player is provided a token 13 of a plurality of tokens indicative of memorabilia of the decade defined by the 1950's, such as a fuzzy dice or a juke box. Travel along the serpentine path is directed by a spinner plate 14, including a spinner disk 15 mounted thereon. The spinner disk 15 defined by an annular array of variously colored segments, each of a differing coloration of an adjacent segment defining a predetermined number of colorations. Each coloration is associated with a predetermined stack of cards, wherein the number of colorations is equal to the predetermined number of categories of card decks or stacks 18. Upon spinning of the arrow 16 about its axis, the arrow will land upon a colored segment of the annular array of segments to direct a player to respond to a question regarding the decade of the 1950's. The card will direct a player a predetermined number of spaces upon correct response. The categories of spaces will include sports, music, movies, famous people, geography, and general history of the decade of the 1950's.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of playing a trivia game by a plurality of players, comprising, providing a game board with a rectangular matrix of spaces, wherein the game board is defined by parallel adjacent columns, each column including a predetermined number of the spaces, and providing each player a token, and directing each player to follow a continuous serpentine path along the adjacent columns, and providing a chance member to direct random movement along the serpentine path, wherein the chance member is formed to include a central spinner member, and the spinner member positioned medially of an annular array of variously colored segments defined by a predetermined number of colorations, and providing a plurality of decks of cards equal to the predetermined number of colorations, whereupon an individual player effecting spinning of the chance member directs positioning of the chance member to a predetermined color of the plurality of colorations and selects a card in association with the coloration and upon proper response to the card, is directed to proceed along the serpentine path, and wherein the serpentine path is formed to include first spaces in reverse chronological order by date with each card of the decks of cards providing questions in association with each chronological date, and a starting time is provided at an initial space of the spaces, and a terminal space is provided at an ending of the serpentine path, with each of the spaces indicating dates equally spaced apart in time along the serpentine path, and further including second spaces randomly positioned along the serpentine path directing a player to traverse the serpentine path in a counter direction as a penalty upon landing upon one of the second spaces.

* * * * *